US006413711B1

(12) United States Patent
Kimura

(10) Patent No.: US 6,413,711 B1
(45) Date of Patent: Jul. 2, 2002

(54) PHOTOTHERMOGRAPHIC MATERIAL

(75) Inventor: Soc Man Ho Kimura, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/656,019

(22) Filed: Sep. 5, 2000

(30) Foreign Application Priority Data

Sep. 9, 1999 (JP) ..... 11-255557

(51) Int. Cl.[7] ..... G03C 1/498

(52) U.S. Cl. ..... 430/619; 430/510; 430/517; 430/583; 430/584; 430/591; 430/944

(58) Field of Search ..... 430/517, 510, 430/619, 583, 584, 591, 588, 944

(56) References Cited

U.S. PATENT DOCUMENTS 5,380,635 A 1/1995 Gomez et al.
6,265,146 B1 * 7/2001 Kashiwagi ..... 430/584

FOREIGN PATENT DOCUMENTS

EP 0994381 4/2000

OTHER PUBLICATIONS

European Search Report EP 00 30 7612 Patent Abstracts of Japan, Publication #58145936, Publication date: Aug. 31, 1983 (one page).

* cited by examiner

*Primary Examiner*—Thorl Chea
(74) *Attorney, Agent, or Firm*—Bierman, Muserlian and Lucas

(57) ABSTRACT

A photothermographic material is disclosed, comprising a support and a photosensitive layer containing an organic silver salt, a photosensitive silver halide and a binder, wherein the photosensitive layer or the support contains a dye represented by formula (1), and the photosensitive silver halide being spectrally sensitized with at least a sensitizing dye represented by formulas (2*a*) through (2*d*).

formula (1)

formula (2a)

formula (2b)

formula (2c)

formula (2d)

20 Claims, No Drawings

PHOTOTHERMOGRAPHIC MATERIAL

FIELD OF THE INVENTION

The present invention relates to thermally developable photothermographic materials, and in particular to a photothermographic material exhibiting improved silver image tone and superior image sharpness, reduced deterioration in storage stability, reduced residual dye staining, reduced fogging, and improvements in reduction of sensitivity and in raw stock stability.

BACKGROUND OF THE INVENTION

As is well known, when photographic materials are exposed, incident light is reflected or refracted by silver halide, additives or by the interface of a layer, resulting in blurred images and leading to deterioration in sharpness. To prevent these drawbacks are employed so-called anti-halation dyes (AH dyes) or anti-irradiation dyes (AI dyes). Performance which has been required for the AH dyes and AI dyes is having an absorption within the intended wavelengths, no unwanted influence on a silver halide emulsion and no residual color after processing a photographic material by being completely decolorized or leached out during processing.

As a result of the recent tendency of rapid access or dry processing, a dry processing system completely free of water is often employed, in which thermally developable photothermographic materials are used in a laser imager for medical diagnostic use or an image setter for graphic arts use, having an oscillation wavelength within 600 to 800 nm. A problem of residual color stains caused by dyes remaining in the photographic material after being processed arises, which is different from residual color occurring in conventional silver halide photographic materials.

Thermally developable photothermographic materials are disclosed in, for example, D. Morgan and B. Shely "Dry Silver Photographic Material", in U.S. Pat. Nos. 3,152,904 and 3,457,075; and in D. H. Klosterboer "Thermally Processed Silver Systems" (Imaging Processes and Materials) Neblette, 8th Edition, edited by Sturge, V. Walworth, and A. Shepp, page 279, 1989), etc. The photothermographic material comprises an organic silver salt, a catalytically active amount of photo-catalyst (e.g., silver halide) and a reducing agent, which are contained in the form of a dispersion in an (organic) binder matrix. The photothermographic material forms silver through an oxidation-reduction reaction between a reducible silver source (functioning as an oxidant) and a reducing agent when exposed and heated at a high temperature (e.g., 80° C. or higher). In this case, the oxidation-reduction reaction is promoted by catalytic action of the latent image produced by exposure to light, leading to image formation, based on such exposure.

Since no water is used in processing, no dye leaches out of the photothermographic material, which produces problems in absorption in the visible region, caused by residual dyes, and for which an improvement is desired.

Representative examples of infrared absorbing AI and AH dyes are organic dyes and there have been proposed a large number of compounds, as AI and AH dyes. Specifically, cyanine dyes and oxonol dyes are often used. However, these dyes exhibit a relatively large absorption in the visible region and their degradation product, which results in an yellow absorption, are disadvantageous in terms of residual color stains, having further defects that the compounds are not only unstable and liable to decompose, but also relatively high in cost.

Some squarylium dyes are known to exhibit infrared absorption, as disclosed in JP-A 10-36695, 10-104779 and 10-158253 (hereinafterm the term JP-A refers to an unexamined, published Japanese Patent Application). JP-A 2-216140 and JP-A 10-24654 propose the use of infrared squaryliun dyes as AI and AH dyes in photothermographic materials and silver halide photographic materials. However, dyes described in JP-A 10-24654 are not suitable in spectral absorption characteristics and have an absorption in the visible region, producing the disadvantage that the photographic material is colored. Even when incorporated in the form of a solid particle dispersion, the visible absorption is still large and satisfied performance was not displayed.

To overcome such disadvantages, squarylium dyes advantageously applicable to photothermographic material to prevent deterioration in sharpness are disclosed in U.S. Pat. No. 4,508. Of these, specifically, a squarylium dye having a thiopyrylium nucleu, a squarylium dye having a pyrylium nucleus, or pyrylium croconium dye and thiopyrylium croconium dye which are similar to the squarylium dye exhibit a small absorption in the visible region, having characteristics suited to AH and AI dyes.

In cases when these squarylium dye and croconium dye are applied, as a AH or AI dye, to photothermographic materials, and specifically when used in combination with commonly known infrared sensitizing dyes, it was proved that desensitization, increased fogging or deterioration in storage stability occurred, and therefore it is important to overcome such problems.

As a result of the inventor's study of infrared sensitizing dyes used in combination with a squarylium dye, it was found that a photothermographic material exhibiting lower fogging and higher sensitivity was obtained by the use of an infrared sensitizing dye having a specific structure, thereby leading to improvements in storage stability of the photothermographic material.

SUMMARY OF THE INVENTION

It is an object of the present invention to provide a photothermographic material exhibiting superior image sharpness and raw stock stability, used for a laser imager, and also a photothermographic material exhibiting high contrast, lower fogging and higher sensitivity and superior raw stock stability, used for image setter output films.

The object of the invention can be accomplished by the following constitution:

1. A photothermographic material comprising a support, a layer containing an organic silver salt, a photosensitive silver halide and a binder, wherein a layer constituting the photothermographic material or the support contains a dye represented by the following formula (1), and the photosensitive silver halide being spectrally sensitized with at least a sensitizing dye represented by the following formulas (2a) through (2d):

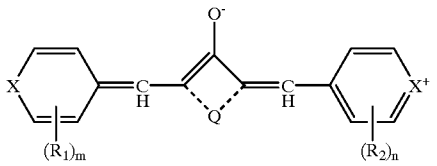

wherein Q represents

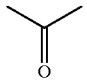

x represents and oxygen or

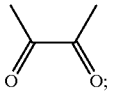

X represents an oxygen or sulfur atom; $R_1$ and $R_2$ each represent a univalent substituent group; m and n are each 0, 1, 2, 3 or 4;

formula (2a)

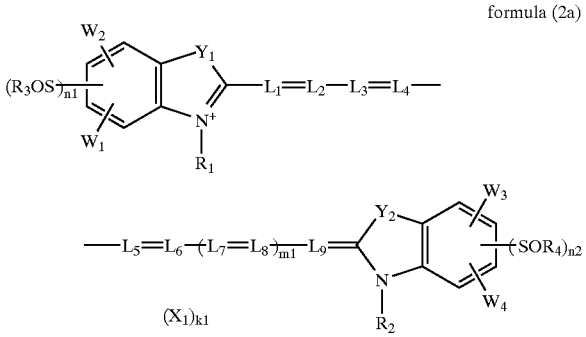

formula (2b)

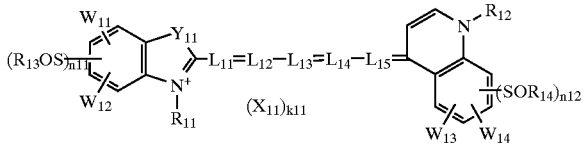

formula (2c)

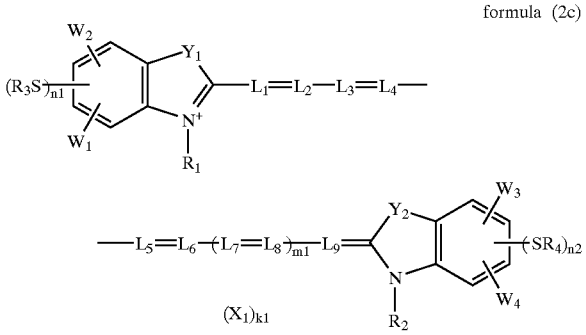

formula (2d)

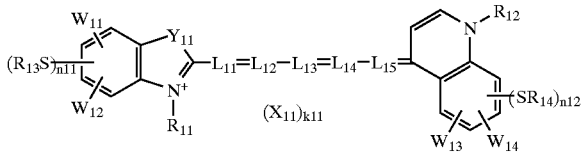

wherein $Y_1$, $Y_2$ and $Y_{11}$ each represent an oxygen atom, sulfur atom, selenium atom or —CH=CH—; $L_1$ through $L_9$ and $L_{11}$ through $L_{15}$ each represent a methine group; $R_1$, $R_2$, $R_{11}$ and $R_{12}$ each represents an aliphatic group; $R_3$, $R_4$, $R_{13}$ and $R_{14}$ each represent an alkyl group, a cycloalkyl group, an alkenyl group, an aralkyl group, an aryl group or a heterocyclic ring group; $W_1$, $W_2$, $W_3$, $W_4$, $W_{11}$, $W_{12}$, $W_{13}$, and $W_{14}$ each represent a hydrogen atom or a substituent group, or a non-metallic atom group necessary to form a condensed ring by bonding between $W_1$ and $W_2$, $W_3$ and $W_4$, $W_{11}$ and $W_{12}$, or $W_{13}$ and $W_{14}$, or a non-metallic atom group necessary to form a 5- or 6-membered condensed ring by bonding between $R_3$ and $W_1$, $R_3$ and $W_2$, $R_{13}$ and $W_{11}$, $R_{13}$ and $W_{12}$, $R_4$ and $W_3$, $R_4$ and $W_4$, $R_{14}$ and $W_{13}$, or $R_{14}$ and $W_{14}$; $X_1$ and $X_{11}$ each represent an ion necessary to compensate for an intramolecular charge; k1 and k11 represent the number necessary to compensate for an intramolecular charge; m1 is 0 or 1; n1, n2, n11 and n12 are each 0, 1 or 2, provided that n1 and n2, or n11 and n12 are 0 at the same time;

2. An image forming method, wherein the photothermographic material described in 1 is exposed to an infrared laser light;

3. The image forming method described in 2, wherein the photothermographic material is exposed with a laser scanning exposure apparatus, in which the laser light and the exposed surface of the photothermographic material are not substantially at right angles to each other;

4. The image forming method described in 2, wherein the photothermographic material is exposed with a laser scanning exposure apparatus, in which the laser light is a longitudinally multiple laser light;

5. An image forming method, wherein the photothermographic material described in 1 is developed by heating at a temperature of not lower than 80° C. and not higher than 200° C.

DETAILED DESCRIPTION OF THE INVENTION

The present invention will be further explained.

As described above, in cases when the squarylium dye or croconium dye represented by formula (1) is applied, as an anti-halation dye (AH dye) or anti-irradiation dye (AI dye), to photothermographic materials, specifically in cases when used in combination with commonly known infrared sensitizing dyes, desensitization, increased fogging or deterioration in storage stability resulted. It was proved that such problems varied with the kind of a cyanine dye or merocyanine dye used as a spectrally sensitizing dye in the photothermographic material. In view thereof, presuming that the presence of the squarylium dye affects adsorption of these dyes, the inventor made studies of infrared sensitizing dyes used in combination with the squarylium dye. As a result, it was found that the use of an infrared sensitizing dye, adsorption of which is barely affected by the squarylium dye improved adsorption of the infrared sensitizing dye onto silver halide and controlled chemical sensitization and spectral sensitization of silver halide grains, leading to formation of a stable sensitivity speck and thereby the problems described above were overcome.

Thus, it was found that a photothermographic material exhibiting high sensitivity and low fog could be obtained by the use of a squarylium dye represented by formula (1) in combination with an infrared sensitizing dye represented by formulas (2a) through (2d) and an improvement in storage stability of the photothermographic material was achieved.

The infrared dye compounds used in this invention is now described in detail. Dyes used in this invention include a squarylium dye having a thiopyrylium nucleus (hereinafter, also called a thiopyryliumsquarylium dye), a squarylium dye having a pyrylium nucleus (hereinafter, also called a pyryliumsquarylium dye), and thiopyryliumcroconium and pyryliumcroconium dyes similar to the squarylium dye. In this invention, the compound having a squarylium nucleus refers to a compound having 1-cyclobutene-2-hydroxy-4-one in its molecular structure and the compound having a croconium nucleus refers to a compound having 1-cyclobutene-2-hydroxy-4-5-dione in its molecular structure, in which the hydroxy group may be dissociated. Hereinafter, all of these compounds are referred to as a squarylium dye.

Next, the compound represented by formula (1) will be further described. The compound of formula (1) is also represented by the following formula (1a) or (1b):

formula (1-a)

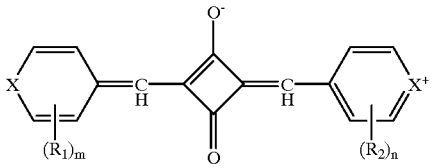

formula (1-b)

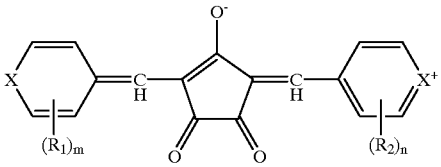

In formulas (1), (1a) and (1b), $R_1$ and $R_2$ each represent a univalent substituent group. The univalent substituent group is not specifically limited but preferably an alky group (e.g., methyl, ethyl, isopropyl, tert-butyl, methyoxyethyl, methoxyethoxyethyl, 2-ethylhexyl, 2-hexyldecyl, benzyl, etc.) and an aryl group (e.g., phenyl, 4-chlorophenyl, 2,6-dimethylphenyl, etc.), more preferably an alkyl group, and still more preferably tert-butyl. $R_1$ and $R_2$ may combine together with each other to form a ring; m and n are each an integer of 0 to 4, and preferably an integer of not more than 2.

Exemplary examples of the dye used in this invention are shown below, but are not limited to these.

1-1

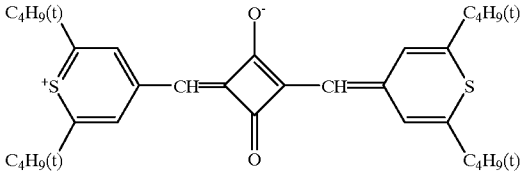

1-2

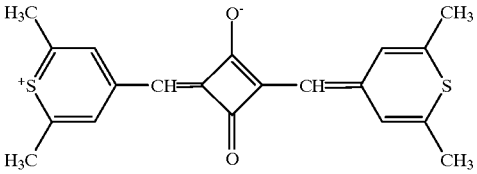

1-3

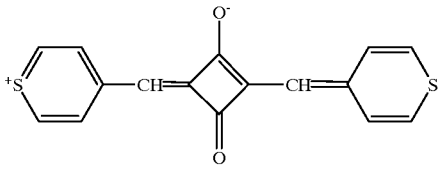

-continued 1-4

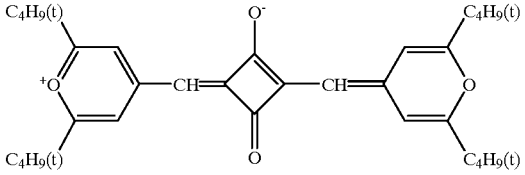

1-5

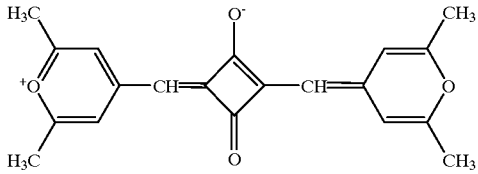

1-6

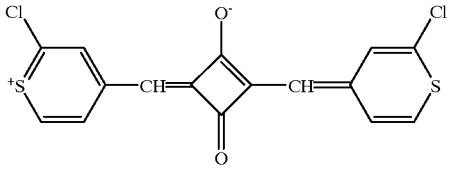

1-7

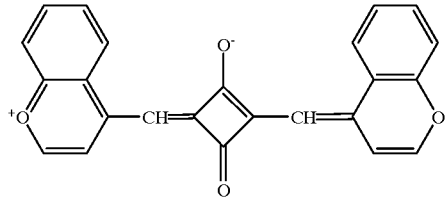

1-8

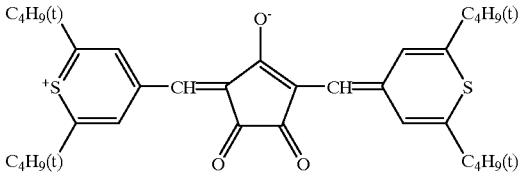

1-9

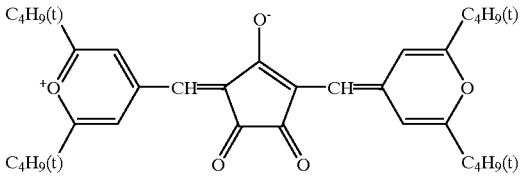

1-10

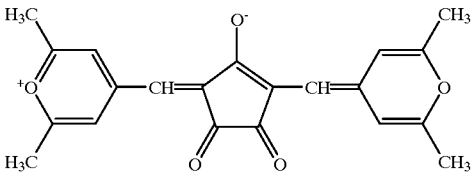

1-11

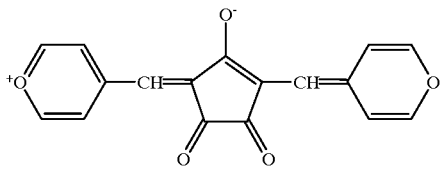

-continued 1-12

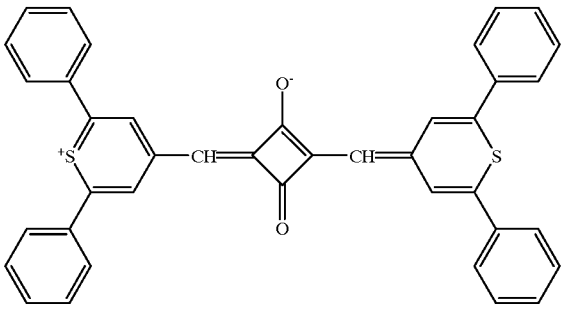

1-13

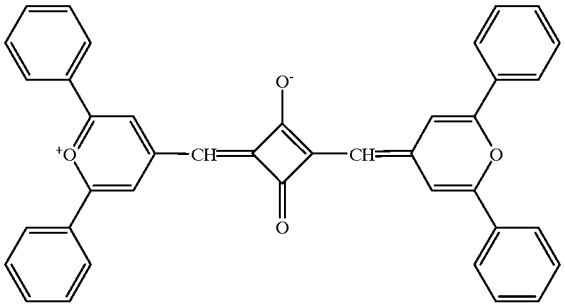

The squarylium dyes can be synthesized according to the method described in JP-A 61-73770, 7-219139 and 9-90547; U.S. Pat. No. 5,625,062; and J. Chem. Soc. , Chem. Commun. page 452–454 (1993).

When the dye of formula (1) is incorporated to a sensitive layer, it is generally incorporated through solution in a solvent, but it can be incorporated in the form of so-called a solid particle dispersion. When incorporated to the thermally developable photosensitive layer, light scattering can be the most effectively restrained, and when incorporated to a thermally developable photosensitive layer spectrally sensitized to the infrared region of 780 to 830 nm, a marked improvement in sharpness can be achieved.

In this invention, the dye in the form of a solid particle dispersion is a dispersion of solid particles having a mean sphere-equivalent radius of not more than 1,000 $\mu$m. The mean sphere-equivalent radius is preferably not more than 200 $\mu$m, and more preferably not more than 100 $\mu$m in terms of reduced light scattering. In this case, the lower limit of the mean sphere-equivalent radius is 50 nm. In this invention, the dye in a molecular dispersion form is referred to as the dye which independently exists substantially in a molecule unit, not in a solid form. Thus, it is, for example, the state in which the dye is dispersed in a dispersing medium such as a binder or latex, in the form of a solution or in a molecule unit.

In cases when the dye is used in the form of a solution, solvents used therein are preferably high boiling solvents. The high boiling solvent is preferably a solvent having a boiling point of not lower than 100° C., preferably not lower than 120° C., more preferably not lower than 140° C. The dispersing medium is not specifically limited, but preferred examples thereof include water, polymers such as gelatin and polyvinyl pyrrolidine, and mixture thereof.

These dyes are preferably applied to photographic materials which are spectrally sensitized to the near-infrared region, and more preferably, when applied to a near-infrared-sensitive photothermographic material exhibiting a spectral sensitivity maximum within the range of 780 to 830 nm, sharpness is markedly improved. When applied to a photothermographic material which is to be exposed to laser light, sharpness is enhanced and preferred.

The photothermographic material used in this invention may contain the dye of this invention on either side of the support, and preferably on the side opposed to the emulsion-side.

When the dye of this invention is incorporated into the support itself, sharpness is markedly improved and preferred.

The photothermographic material containing the dye of formula (1) on both sides of the support results in enhanced sharpness and is more preferred.

The dye of formula (1) is incorporated to the photothermographic material, preferably in an amount giving 0.3 to 1.5 (more preferably 0.7 to 1.2) of an absorbance at the wavelength of the absorption maximum of the dye.

Next, spectral sensitizing dyes represented by formulas (2a) through (2d) will be detailed.

Examples of the aliphatic group represented by $R_1$, $R_2$, $R_{11}$ and $R_{12}$ include a straight-chain or branched alkyl group having 1 to 10 carbon atoms (e.g., methyl, ethyl, propyl, butyl, pentyl, iso-pentyl, 2-ethyl-hexyl, octyl, decyl), an alkenyl group having 3 to 10 carbon atoms (e.g., 2-prpopenyl, 3-butenyl, 1-methyl-3-propenyl, 3-pentenyl, 1-methyl-3-butenyl, 4-hexenyl), and an aralkyl group having 7 to 10 carbon atoms (benzyl, phenethyl), each of which may be further substituted. Examples of the substituting group include a lower alkyl group (preferably having 1 to 5 carbon atoms, e.g., methyl, ethyl, propyl), a halogen atom (e.g., fluorine atom, chlorine atom bromine atom), a vinyl group, trifluoromethyl, an alkoxy group (e.g., methoxy, ethoxy, methoxyethyl), an aryloxy group (e.g., phenoxy, p-tolyloxy), cyano, a sulfonyl group (e.g., methanesulfonyl, trifluoromethanesulfonyl, p-toluenesulfonyl), an alkoxycarbonyl group (e.g., ethoxycarbonyl, butoxycarbonyl), an amino group (e.g., amino, biscarboxy-methylamino), an aryl group (e.g., phenyl, carboxyphenyl, p-tolyl, p-bromophenyl), a heterocyclic group (e.g., tetrahydrofurfuryl, 2-pyrrolidinone-1-yl), an acyl group (e.g., acetyl, benzoyl), a ureido group (e.g., ureido, 3-methylureido, 3-phenylureido), a thioureido group (e.g., thioureido, 3-methylthioureido), an alkylthio group (e.g., methylthio, ethylthio), an arylthio group (e.g., phenylthio), a heterocyclic-thio group (e.g., 2-thienylthio, 3-thienylthio), a carbonyloxy group (e.g., acetyloxy, propanoyloxy, benzoyloxy), an acylamino group (e.g., acetylamino, benzoylamino), a thioamido group (e.g., thioacetoamido, thiobenzoylamino), and hydrophilic groups such as a sulfo group, carboxy group, phosphono group, sulfato group, hydroxy group, mercapto group, sulfino group, carbamoyl group (e.g., carbamoyl, N-methylcarbamoyl, N,N-tetramethylenecarbamoyl), sulfamoyl group (e.g., sulfamoyl, N,N-3-oxapentamethyleneaminosulfonyl), sulfonamido group (e.g., methanesulfonamido, butanesulfoneamido), sulfonylaminocarbonyl group (e.g., methanesulfonylaminocarbonyl, ethanesulfonylaminocarbonyl), acylaminosulfonyl group (e.g., acetoamidosulfonyl, methoxyacetoamidosulfonyl), acylaminocarbonyl group (e.g., acetoamidocarbonyl, methoxyacetoamidocarbonyl), sulfinylaminocarbonyl group (e.g., methanesulfinylamino-carbonyl, ethanesulfinylaminocarbonyl) and sulfoamino group. Aliphatic groups substituted by such a hydrophilic group include, for example, carboxymethyl, carboxybutyl, carboxypentyl, 3-sulfatobutyl, 3-sulfopropyl, 2-hydroxy-3-sulfopropyl, 4-sulfobutyl, 5-sulfopentyl, 3-sulfobentyl, 3-sulfinobutyl, 3-phosphonopropyl, hydroxyethyl, N-methanesulfonylcarbamoylmethyl, N-acetylaminosulfonylmethyl, sulfoaminopropyl, 2-carboxy-2-propenyl, o-sulfobenzyl, p-sulfophenethyl, and p-carboxybenzyl.

With regard to $R_3$, $R_4$, $R_{13}$ and $R_{14}$, the alkyl group is preferably a straight-chain or branched alkyl group having 5 or less carbon atoms, including methyl, ethyl, propyl, butyl, pentyl and isopropyl. Examples of the cycloalkyl group include cyclopropyl, cyclobutyl and cyclopentyl. Examples of the alkenyl group include 2-propenyl, 3-butenyl, 1-methyl-3-propenyl, 3-pentenyl, 1-methyl-3-butenyl and 4-hexenyl. Examples of the aralkyl group include benzyl, phenethyl, p-methoxyphenylmethyl and o-acetylaminophenylethyl. The aryl group includes substituted and unsubstituted ones, such as phenyl, 2-naphthyl, 1-naphthyl, o-tolyl, o-methoxyphenyl, m-chlorophenyl, m-bromophenyl, p-tolyl, and p-ethoxyphenyl. The heterocyclic ring group includes substituted and unsubstituted ones, such as 2-furyl, 5-methyl-2-furyl, 2-thienyl, 3-thienyl, 2-imdazolyl, 2-methyl-l-imidazolyl, 4-phenyl-2-thiazolyl, 5-hydroxy-2-benzothiazolyl, 2-pyridyl, and 1-pyrrolyl. These groups may be substituted and examples of the substituent group include a lower alkyl group (preferably having 1 to 5 carbon atoms, e.g., methyl, ethyl, etc.), a lower alkoxy group (preferably having 1 to 5 carbon atoms, e.g., methoxy, ethoxy, etc.), hydroxy, a halogen atom (e.g., fluorine, chlorine, bromine, iodine), an aryl group (e.g., phenyl, tolyl, chlorophenyl, etc.), mercapto group, and a lower alkylthio group (preferably having 1 to 5 carbon atoms, e.g., methylthio, ethylthio, etc.).

The substituent groups represented by each of $W_1$ through $W_4$ and $W_{11}$ through $W_{14}$ include, for example, an alkyl group (e.g., methyl, ethyl, butyl, isobutyl, etc.), an aryl group (including a monocyclic and polycyclic ones, e.g., phenyl, naphthyl, etc.), a heterocyclic ring group (e.g., thienyl, furyl, pyridyl, carbazolyl, pyrrolyl, indolyl, etc.), a halogen atom (e.g., fluorine, chlorine, bromine, iodine), a vinyl group, an aryl group (e.g., phenyl, p-tolyl, p-bromophenyl, etc.), trifluoromethyl, an alkoxy group (e.g., methoxy, ethoxy, methoxyethoxy, etc.), an aryloxy group (e.g., phenoxy, p-tolyloxy, etc.), a sulfonyl group (e.g., methanesulfonyl, p-toluenesulfonyl, etc.), an alkoxycarbonyl group (e.g., ethoxycarbonyl, butoxycarbonyl, etc.), an amino group (e.g., amino, biscarboxy-methylamino, etc.), an aryl group (e.g., phenyl, carboxyphenyl, etc.), a heterocyclic ring group (e.g., tetrahydrofurfuryl, 2-pyrrolidinone-1-yl, etc.), an acyl group (e.g., acetyl, benzoyl, etc.), an ureido group (e.g., ureodo, 3-methylureido, 3-phenylureido, etc.), a thioureido group (e.g., thioureido, 3-methylthioureido, etc.), an alkylthio group (e.g., methylthio, ethylthio, etc.), an arylthio group (e.g., phenylthio, etc.), hydroxy and a styryl group. These group each may be substituted and examples of the substituent group include the same as defined in the aliphatic group represented by $R_1$. Examples of substituted alkyl groups include 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenethyl, carboxymethyl, carboxymethyl, allyl and 2-furylethyl. Examples of substituted aryl groups include p-carboxyphenyl, p-N,N-dimethylaminophenyl, p-morpholinophenyl, p-methoxyphenyl, 3,4-dimethoxyphenyl, 3,4-methylenedioxyphenyl, 3-chlorophenyl and p-nitrophenyl. Examples of substituted heterocyclic ring groups include 5-chloro-2-pyridyl, 5-ethoxycarbonyl-2-pyridyl, and 5-carbamoyl-2-pyridyl.

The condensed rings by bonding between $W_1$ and $W_2$, $W_3$ and $W_4$, $W_{11}$ and $W_{12}$, $W_{13}$ and $W_{14}$, $R_3$ and $W_1$, $R_3$ and $W_2$, $R_{13}$ and $W_{11}$, $R_{13}$ and $W_{12}$, $R_4$ and $W_3$, $R_4$ and $W_4$, $R_{14}$ and $W_{13}$, or $R_{14}$ and $W_{14}$ include, for example, 5- or 6-membered, saturated or unsaturated, condensed carbocyclic rings. The condensed rings may be substituted at any position on the ring. The substituent groups include the same as defined in the aliphatic group.

In formulas (2a) through (2d), the methine group represented by $L_1$ through $L_9$ and $L_{11}$ through $L_{15}$ is a substituted or unsubstituted methine group. The substituent group include, for example, a substituted or unsubstituted, lower alky group (preferably having 1 to 5 carbon atoms, e.g., methyl, ethyl, iso-propyl, benzyl), alkoxy group (e.g., methoxy, ethoxy), aryloxy group (e.g., phenoxy, naphthoxy), aryl group (e.g., phenyl, naphthyl, p-tolyl, o-carboxyphenyl), —N($V_1$, $V_2$) group, —SR group or a heterocyclic group (e.g., 2-thienyl, 2-furyl, N,N-bis (methoxyethyl) barbituric acid, in which $R_1$ is a lower alky group, aryl group or heterocyclic group, and $V_1$ and $V_2$ are each substituted or unsubstituted lower alkyl (preferably having 1 to 5 carbon atoms) or aryl group, or $V_1$ and $V_2$ link together with each other to form a 5- or 6-membered, nitrogen-containing ring. The methine can link together with an adjacent one or one next thereto to form a 5- or 6-membered ring.

In cases where the compound represented by formula (2a) through (2d) is substituted by a cationic or anionic group, an equivalent amount of anionic or cationic counter ion is formed to compensate for an intramolecular charge. Of the ion necessary to neutralize an intramolecular charge, represented by $X_1$ or $X_{11}$, examples of the cation include proton, organic ammonium ion (e.g., triethylammonium, triethanolammonium, pyridinium, etc.) and inorganic ions (e.g., lithium, pyridinium, calcium, and magnesium ions, etc.) Examples of acid anions include halide ions (chloride ion, bromide ion, iodide ion), p-toluenesulfonic acid ion, perchlorate ion, tetrafluoroborate ion, sulfate ion, methylsulfate ion, ethylsulfate ion, methanesulfonic acid ion, and trifluoromethanesulfonic acid ion.

Exemplary examples of the sensitizing dyes represented by formulas (2a) through (2d) are shown below, but are not limited to these.

No. 1
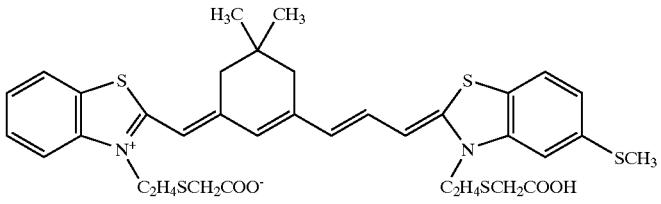
No. 2
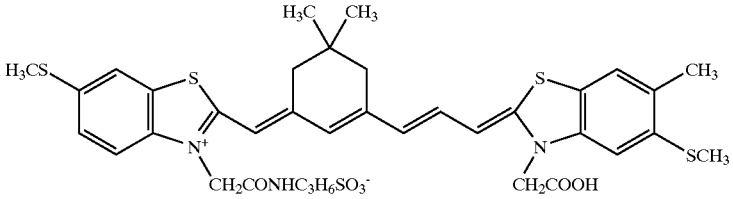
No. 3
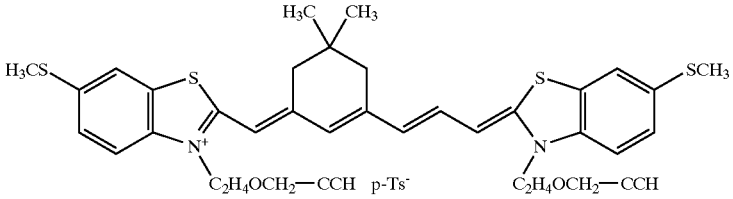
No. 4
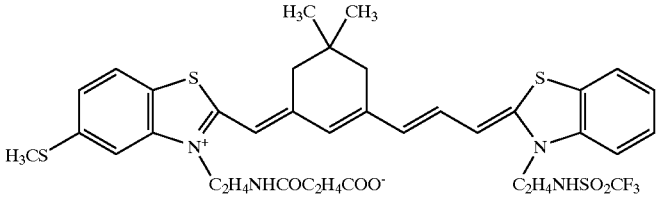
No. 5
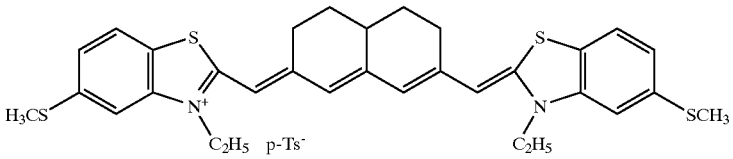
No. 6
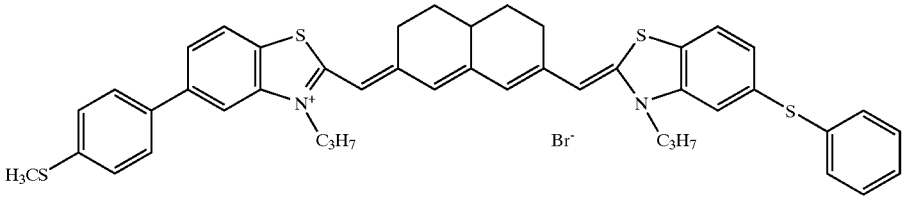
No. 7
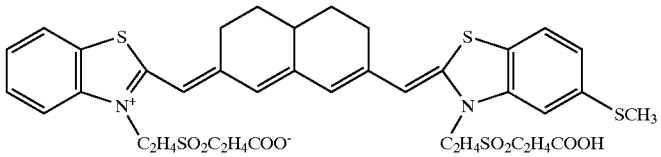
No. 8
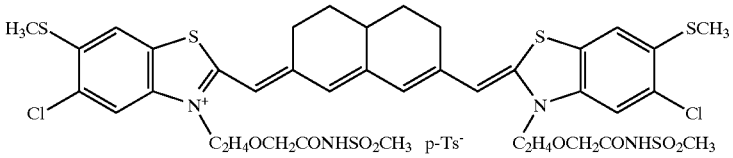

-continued
No. 9
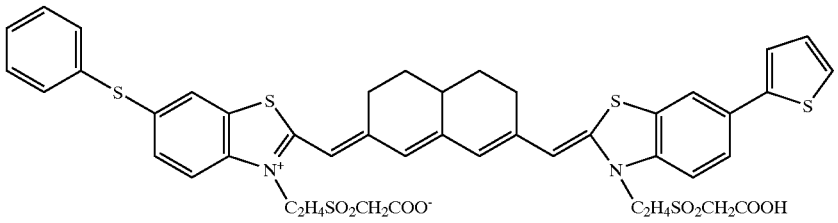
No. 10
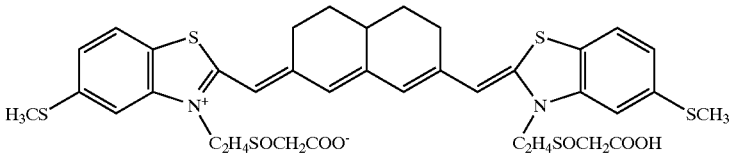
No. 11
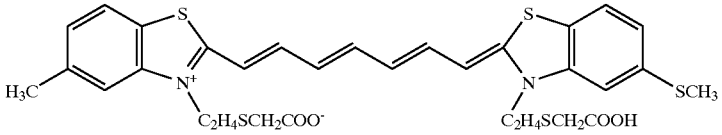
No. 12
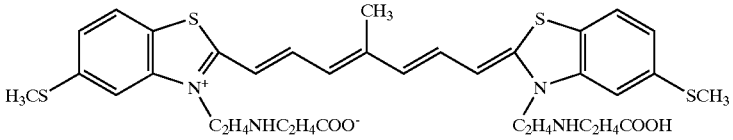
No. 13
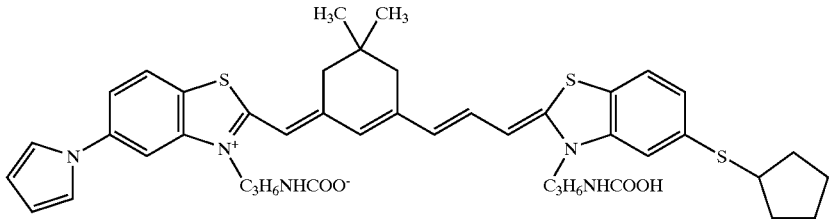
No. 14
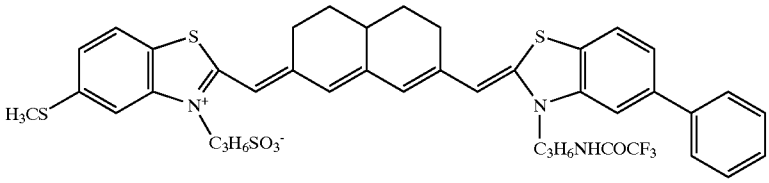
No. 15
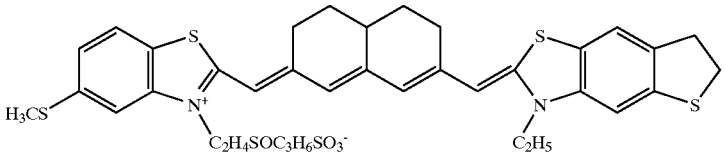
No. 16
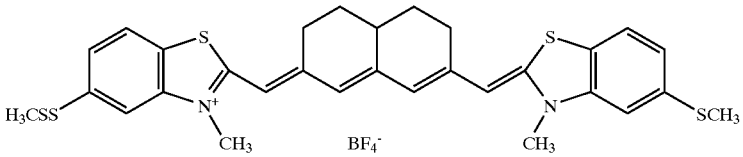

-continued
No. 17
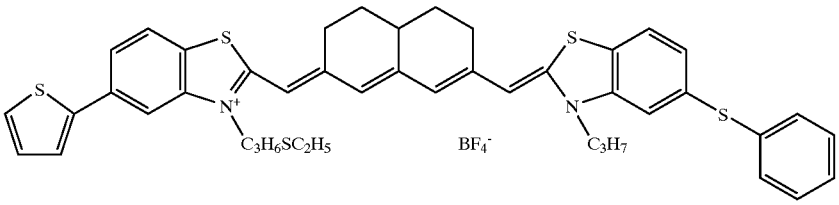
No. 18
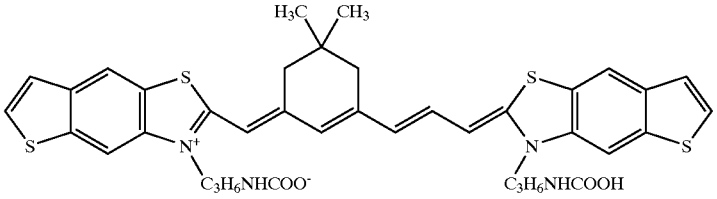
No. 19
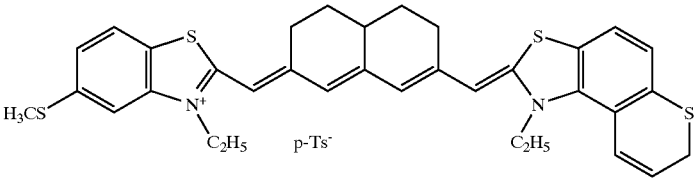
No. 20
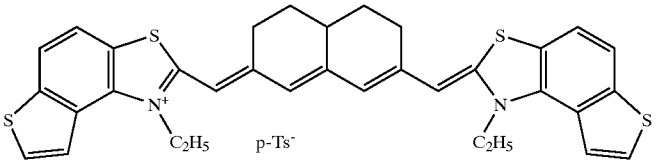
No. 21
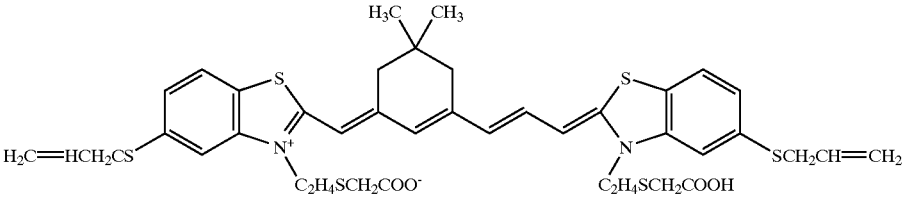
No. 22
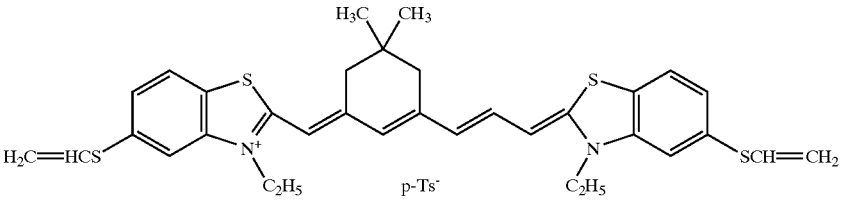
No. 23
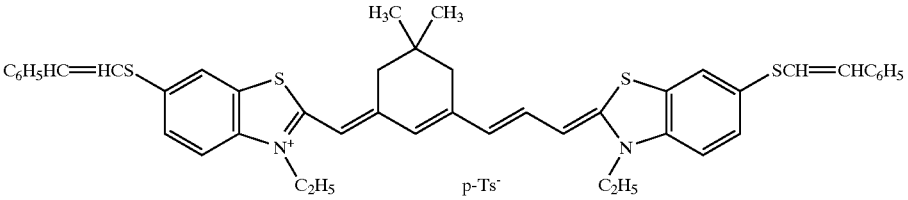
No. 24
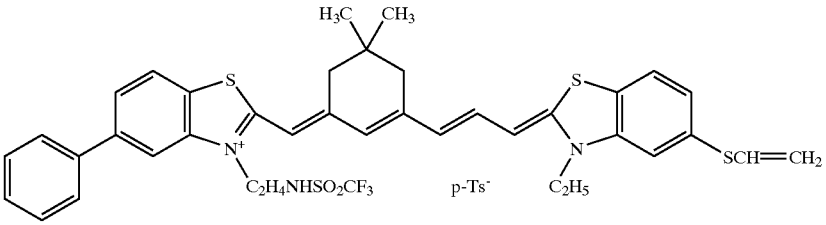

-continued
No. 25
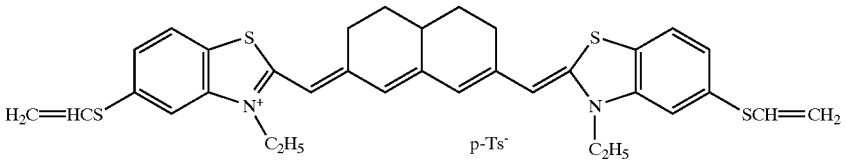
No. 26
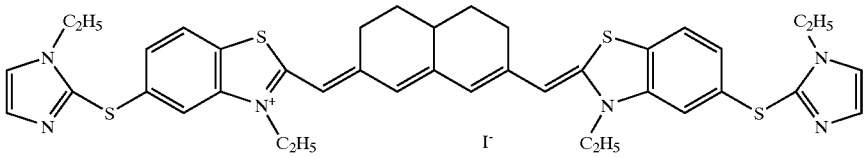
No. 27
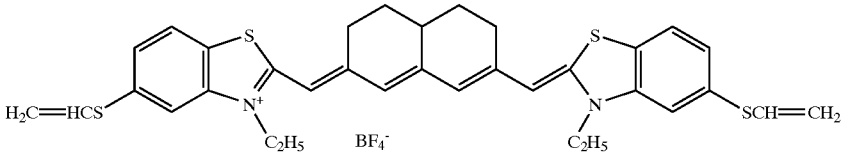
No. 28
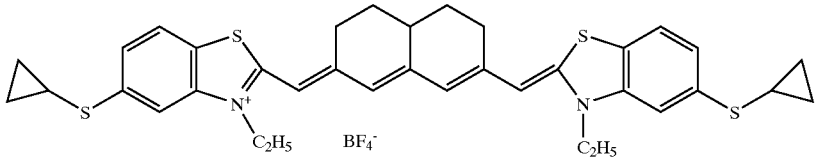
No. 29
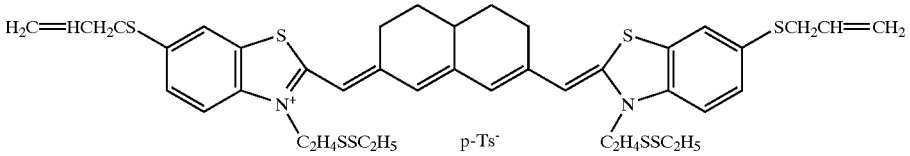
No. 30
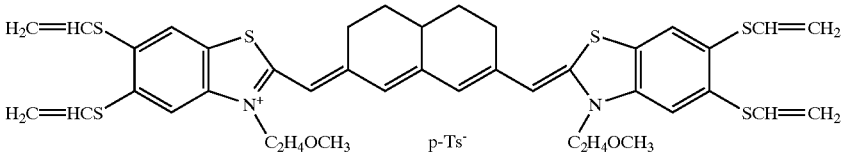
No. 31
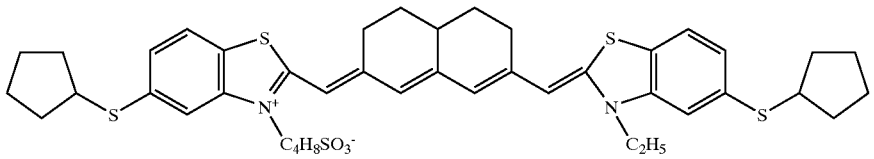
No. 32
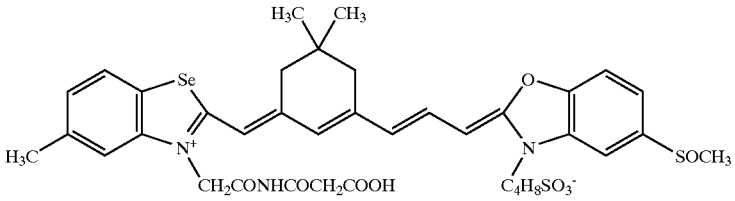
No. 33
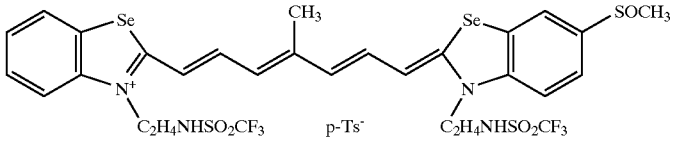

-continued
No. 34
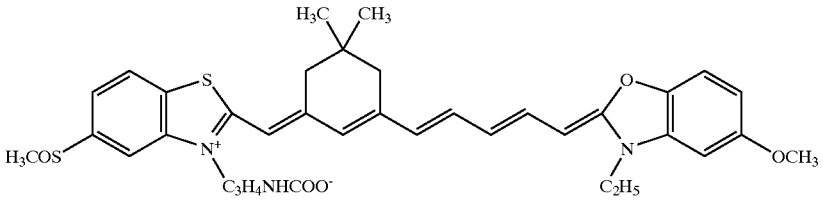
No. 35
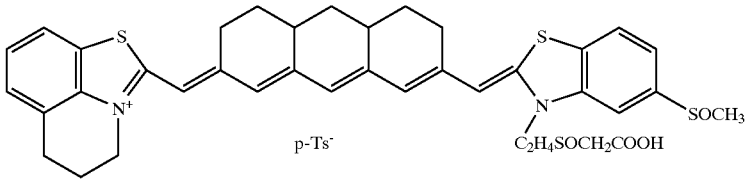
No. 36
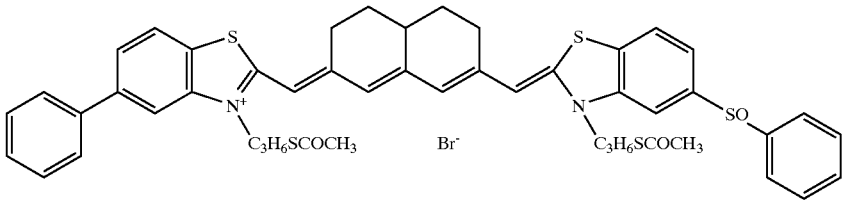
No. 37
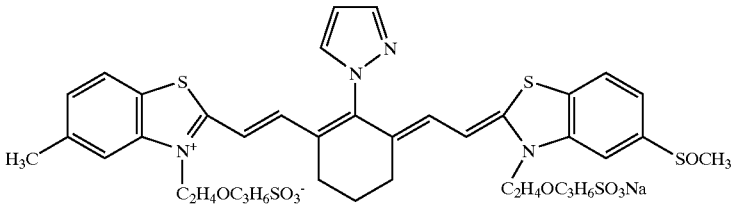
No. 38
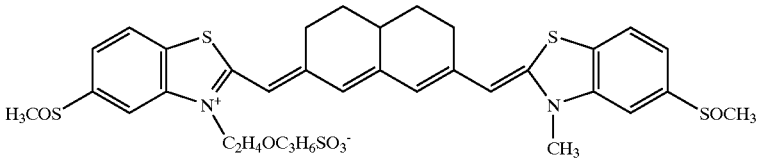
No. 39
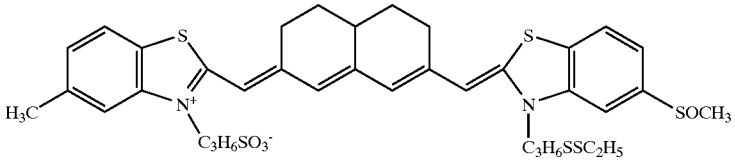
No. 40
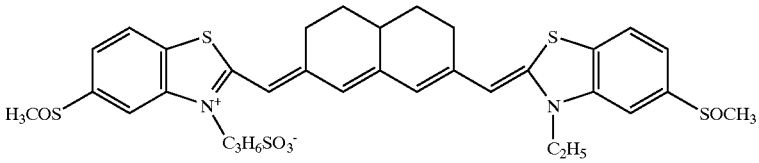
No. 41
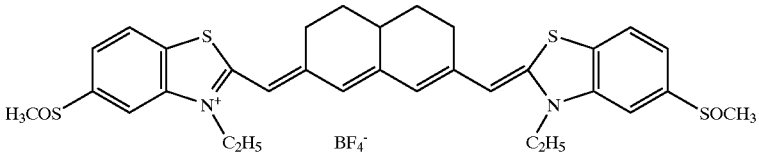

-continued
No. 42
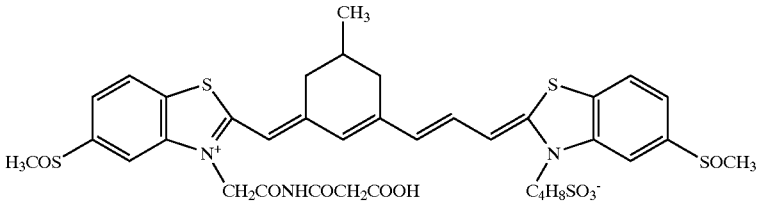
No. 43
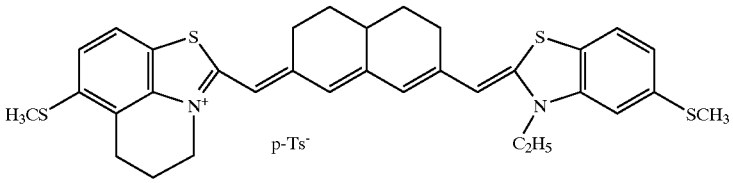
No. 44
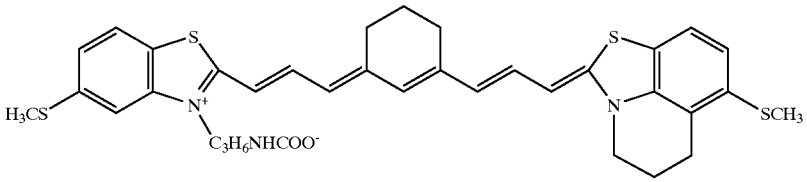
No. 45
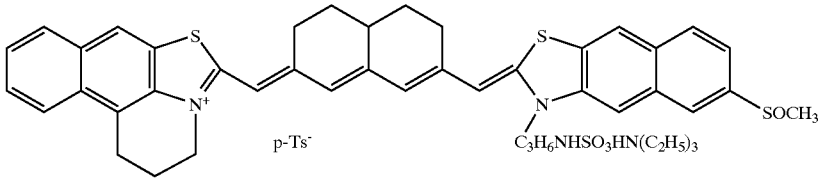
No. 46
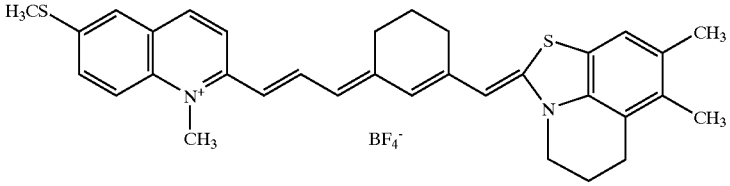
No. 47
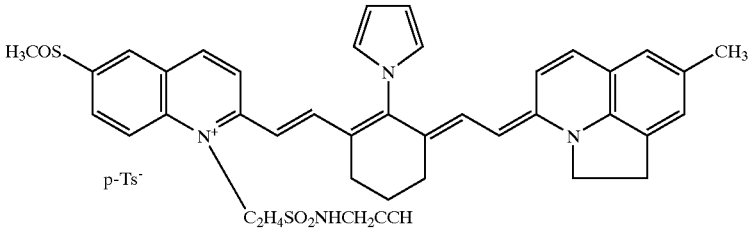
No. 48
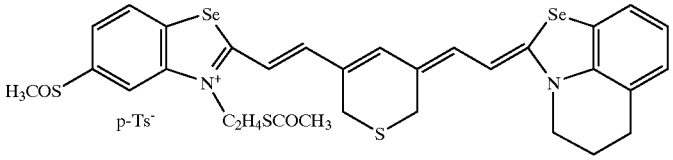
No. 49
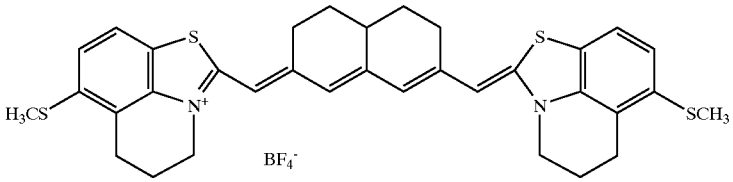

-continued

No. 50

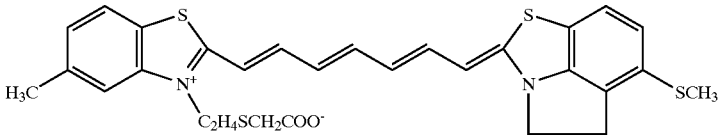

No. 51

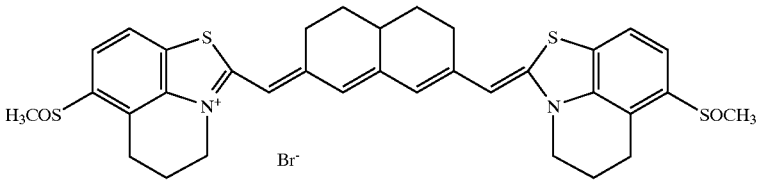

No. 52

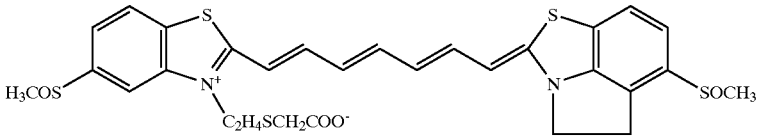

No. 53

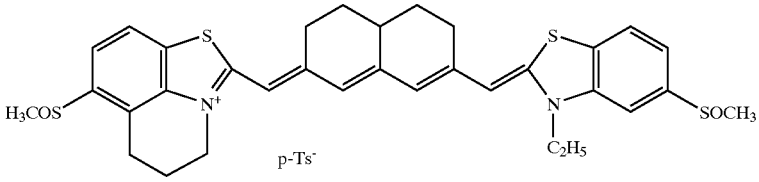

The infrared sensitizing dyes described earlier can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964); JP-A 3-138638 and 10-73900; WO/JP-A 9-510022; U.S. Pat. No. 2,734,900 and British patent 774,779; JP-A 12-95958, and Japanese Patent Application No. 11-58686.

Of these sensitizing dyes of formulas (2a) through (2d), dyes of formula (2a) through (2c) are preferred, dyes of formula (2a) or (2c) are more preferred and dyes of formula (2a) are most preferred, in terms of low fogging, high sensitivity and enhanced storage stability.

The sensitizing dye used in this invention may be used alone or in combination. In either case when used alone or used in combination, the total amount of the dye(s) to be incorporated is preferably $1\times10^{-6}$ to $5\times10^{-3}$, more preferably $1\times10^{-5}$ to $2.5\times10^{-3}$, and still more preferably $4\times10^{-5}$ to $1\times10^{-3}$ mol per mol of silver halide. In cases when dyes are used in combination, the dyes can be incorporated in any proportion.

The dye may be directly dispersed in a silver halide emulsion. Alternatively, the may be dissolved in an appropriate solvent such as methanol, ethanol, n-propanol, methyl cellosolve, acetone, water, pyridine, or a mixture thereof and added to the emulsion in the form of a solution. Ultrasonic can also be employed. The sensitizing dye can be added in such a manner that a dye is dissolved in a volatile organic solvent, the resulting solution is dispersed in a hydrophilic colloidal medium and the dispersion is added to the emulsion, as described in U.S. Pat. No. 3,469,987; a water-insoluble dye is dispersed in aqueous medium without being dissolved and the dispersion is added to the emulsion, as described in JP-B 46-24185 (hereinafter, the term, JP-B means a published Japanese Patent); a dye is dissolved using a surfactant and the resulting solution is added to the emulsion, as described in U.S. Pat. No. 3,822,135; a dye is dissolved using a compound capable of shifting to longer wavelengths and the solution is added to the emulsion, as described in JP-A 51-74624; or a dye is dissolved in an acid substantially containing no water and the solution is added to the emulsion, as described in JP-A 50-80826. Further, the dye may be added according to the method described in U.S. Pat. Nos. 2,912,343, 3,342,605, 2,996,287 and 3,492,835.

The dye may be homogeneously dispersed in a silver halide emulsion before coating on a support, or may be dispersed at any stage of preparing the silver halide emulsion.

In cases when used in combination, the dyes can be independently or in the form of a mixture dispersed in a silver halide emulsion. Together with the dye(s), a visible region-absorbing dye capable of exhibiting supersensitization, a dye not exhibiting supersensitization, or a compound having no absorption in the visible region may be incorporated into the emulsion. Usable sensitizing dyes and substances exhibiting supersensitization in combination with the dye are described in Research Disclosure (hereinafter, also denoted as "RD") vol. 176, item 17643 (December, 1978) page 23, section IV-J; JP-B 49-15500 and 43-4933; and JP-A 59-19032, 3-15049 and 62-123454.

These dyes may be incorporated to a photosensitive layer containing a dispersion of silver halide and an organic silver salt in which the silver halide and organic silver salt are mixed in contact with each other. In that case, the sensitizing dye is dissolved in an appropriate solvent and added to a coating solution of the photosensitive layer. The addition may be made at any stage and in general, addition at the time of after preparing an organic silver salt dispersion containing silver halide and immediately before coating is general in terms of convenience in production. In this case, sensitizing dyes may be added singly or in combination thereof, or may be used in combination with the substance exhibiting supersensitization. Alternatively, the sensitizing dye may be added in the form of a solid particle dispersion, without being completely dissolved.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. of these organic silver salts, silver salts of fatty acids are preferred, and silver salts of behenic acid, arachidic acid and stearic acid are specifically preferred. The coating amount of an organic silver salt is preferably 0.1 to 3 g/m$^2$, more preferably 0.1 to 2 g/m$^2$, and still more preferably 0.5 to 1.5 g/m$^2$.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed.

Photosensitive silver halide emulsions usable in the thermally developable photosensitive materials according to the invention can be prepared according to the methods commonly known in the photographic art, such as single jet or double jet addition, or ammoniacal, neutral or acidic precipitation. Thus, the silver halide emulsion is prepared in advance and then the emulsion is mixed with other components of the invention to be incorporated into the composition used in the invention. To sufficiently bring the photosensitive silver halide into contact with an organic silver salt, there can be applied such techniques that polymers other than gelatin, such as polyvinyl acetal are employed as a protective colloid in the formation of photosensitive silver halide, as described in U.S. Pat. Nos. 3,706,564, 3,706,5653, 713,833 and 3,748,143, British Patent 1,362,970; gelatin contained in a photosensitive silver halide emulsion is degraded with an enzyme, as described in British Patent 1,354,186; or photosensitive silver halide grains are prepared in the presence of a surfactant to save the use of a protective polymer, as described in U.S. Pat. No. 4,076,539.

Silver halide used in the invention functions as light sensor. Silver halide grains are preferably small in size to prevent milky-whitening after image formation and obtain superior images. The grain size is preferably not more than 0.1 $\mu$m, more preferably, 0.01 to 0.1 $\mu$m, and still more preferably, 0.02 to 0.08 $\mu$m. The form of silver halide grains is not specifically limited, including cubic or octahedral, regular crystals and non-regular crystal grains in a spherical, bar-like or tabular form. Halide composition thereof is not specifically limited, including any one of silver chloride, silver chlorobromide, silver iodochlorobromide, silver bromide, silver iodobromide, and silver iodide. The amount of silver halide is preferably not more than 50%, more preferably 0.1 to 25%, and still more preferably 0.1 to 15%, based on the total amount of silver halide and an organic silver salt.

Photosensitive silver halide used in the photothermographic material of the invention can be formed simultaneously with the formation of organic silver salt by allowing a halide component such as a halide ion to concurrently be present together with organic silver salt-forming components and further introducing a silver ion thereinto during the course of preparing the organic silver salt.

Alternatively, a silver halide-forming component is allowed to act onto a pre-formed organic silver salt solution or dispersion or a sheet material containing an organic silver salt to convert a part of the organic silver salt to light-sensitive silver halide. The thus formed silver halide is effectively in contact with the organic silver salt, exhibiting favorable actions. In this case, the silver halide-forming component refers to a compound capable of forming silver salt upon reaction with the organic silver salt. Such a compound can be distinguished by the following simple test. Thus, a compound to be tested is to be mixed with the organic silver salt, and if necessary, the presence of a peal specific to silver halide can be confirmed by the X-ray diffractometry, after heating. Compounds that have been confirmed to be effective as a silver halide-forming component include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof are shown below:

(1) Inorganic halide compound: e.g., a halide compound represented by formula, MXn, in which M represents H, NH4 or a metal atom; n is 1 when M is H or NH4 and a number equivalent to a valence number of the metal atom when M is the metal atom; the metal atom includes lithium, sodium, potassium, cesium, magnesium, calcium, strontium, barium, zinc, cadmium, mercury, tin, antimony, chromium, manganese, cobalt, rhodium, and cerium, and molecular halogen such as aqueous bromine being also effective;

(2) Onium halide: e.g., quaternary ammonium halides such as trimethylphenylammonium bromide, cetylethyldimethylammonium bromide, and trimethylbenzylammonium bromide; and tertiary sulfonium halides such as trimethylsulfonium iodide;

(3) Halogenated hydrocarbons: e.g., iodoform, bromoform, carbon tetrachloride and 2-brom-2-methylpropane;

(4) N-halogenated compounds: e.g., N-chlorosuccinimide, N-bromosucciimde, N-bromophthalimide; N-bromoacetoamide, N-iodosuccinimide, N-bromophthalazinone, N-bromooxazolinone, N-chlorophthalazinone, N-bromoacetoanilide, N, N-dibromobenzenesulfonamide, N-bromo-N-methylbenzenesulfonamide, 1,3-dibromo-4,4-dimethylhydantoin and N-bromourazole;

(5) Other halogen containing compounds: e.g., triphenylmethyl chloride, triphenylmethyl bromide 2-bromoacetic acid, 2-bromoethanol and dichlorobenzophenone.

The silver halide forming component is used stoichiometrically in a small amount per organic silver salt. Thus, it is preferably 0.001 to 0.7 mol, and more preferably 0.03 to 0.5 mol per mol of organic silver salt. The silver halide-forming component may be used in combination. Alternatively, the thus prepared silver halide may be used in combination with silver halide which has been separately prepared. The conditions including a reaction temperature, reaction time and reaction pressure during the process of converting a part of the organic silver salt to silver halide using the silver halide forming component can be appropriately set in accordance with the purpose of preparation. The reaction temperature is preferably −20° C. to 70° C., the reaction time is preferably 0.1 sec to 72 hrs. and the reaction pressure is preferably atmospheric pressure. The reaction is performed preferably in the presence of polymer as a binder, wherein the polymer to be used is preferably 0.01 to 100 weight parts, and more preferably 0.1 to 10 weight parts per 1 weight part of an organic silver salt.

In addition to spectral sensitization with the compound relating to this invention, commonly known chemical sensitization can be undergone under the conditions known in the art, including the pAg, temperature, and time.

The thus formed light-sensitive silver halide can be chemically sensitized with a sulfur containing compound, gold compound, platinum compound, palladium compound, silver compound, tin compound, chromium compound or their combination. The method and procedure for chemical sensitization are described in U.S. Pat. No. 4,036,650, British Patent 1,518,850, JP-A 51-22430, 51-78319 and 51-81124. Reduction sensitization techniques are also applicable, including reduction sensitization with a reducing agent such as thiourea dioxide or ascorbic acid, and so-called silver ripening by the use of an aqueous solution of silver salts such as silver nitrate. As described in U.S. Pat. No. 3,980,482, a low molecular weight amide compound may be concurrently present to enhance sensitivity at the time of converting a part of the organic silver salt to photosensitive silver halide.

To improve reciprocity law failure or adjust contrast, the photosensitive silver halide may be contained with metal ions of the 6th group to 10th group in the periodical table, such as Rh, Ru, Re, Ir, Os, Fe and their complexes and complex ions. Specifically, complex ions are preferred, e.g., Ir complex ions such as $IrCl_6^{2-}$ are preferably contained to improve reciprocity law failure. The metal ions or metal complex ions may be used alone or in combination with plural kinds thereof. The content of the metal ion or metal complex ion is preferably $1\times10^{-9}$ to $1\times10^{-2}$ mol, and more preferably $1\times10^{-8}$ to $1\times10^{-4}$ mol per mol of silver halide.

Compounds, which provide these metal ions or complex ions, are preferably incorporated. into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the following:

aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols;. phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-S-(l-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols [for example, 1,1-bis(2-hydroxy-3,5-dimethylphenyl)-3,5,5-trimethylhexane, 1,1-bis(2-hydroxy-3-t-butyl-5-methylphenyl)methane, 1,1-bis((2-hydroxy-3,5-di-t-butylphenyl)methane, (2-hydroxy-3-t-butyl-5-methylphenyl)-(2-hydroxy-5-methylphenyl)methane, 1,1-bis(2-hydroxy-3,5-diethylphenyl)-2-methylpropane, 1,1,4,5-tetrkis(2-hydroxy-3,5-dimethylphenyl)-2,4-ethylpentane, 2,2-bis(4-hydroxy-3,5-dimethylphenyl)propane, 2,2-bis(4-hydroxy-3,5-di-t-butylphenyl)propane, bis(2-hyroxy-3-t-butyl-5-methylphenyl)methane, 2,2-bis(4-hydroxy-3-methylphenyl)propane, 4,5-ethylidene-bis(2-t-butyl-6-methyl)phenol, etc.), UV-sensitive ascorbic acid derivatives and 3-pyrazolidones.

Binders suitable for the photothermographic material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinylpyrrolidone), casein, starch, poly(acrylic acid), poly(methylmethacrylic acid), poly(vinyl chloride), poly(methacrylic acid), copoly (styrene-maleic acid anhydride), copoly(styrene-acrylonitrile), copoly(styrene-butadiene), poly(vinyl acetal) series (for example, poly(vinyl formal)and poly(vinyl butyral), poly(ester) series, poly(urethane) series, phenoxy resins, poly(vinylidene chloride), poly(epoxide) series, poly (carbonate) series, poly(vinyl acetate) series, cellulose esters, poly(amide) series. These may be hydrophilic or hydrophobic polymers. Of these, as a binder preferable for the thermally developable photosensitive layer is polyvinyl acetals and more preferably polyvinyl butyral. Cellulose esters exhibiting higher softening temperature, such as triacetyl cellulose or cellulose acetatebutylate are preferred for non-photosensitive layers such as an over-coat layer or sub-coat layer, specifically, a protective layer or backing layer. The amount of a binder in a photosensitive layer is preferably 1.5 to 6 g/m$^2$, and more preferably 1.7 to 5 g/m$^2$. The amount of less than 1.5 g/m2 results in an increase density of an unexposed area to levels unacceptable to practical use.

In this invention, a matting agent is preferably incorporated into the image forming layer side. In order to enhance repeat accuracy of dimensional stability, a polymeric matting agent or an inorganic matting agent is incorporated preferably in an amount of 0.5 to 10% by weight, based on the total binder on the photosensitive layer-side.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in JP-B 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022, 169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent used in this present invention can be incorporated into any layer. In order to accomplish the object of the present invention, the matting agent is preferably incorporated into the layer other than the photosensitive layer, and is more preferably incorporated into the farthest layer from the support.

Addition methods of the matting agent include those in which a matting agent is previously dispersed into a coating composition and is then coated, and prior to the completion of drying, a matting agent is sprayed. When plural matting agents are added, both methods may be employed in combination.

Suitable image tone modifiers usable in the invention include those used in the invention b).

Tone modifiers are preferably incorporated into the thermally developable photosensitive material used in the present invention. Examples of preferred tone modifiers, which are disclosed in Research Disclosure Item 17029, include the following:

imides (for example, phthalimide), cyclic imides, pyrazoline-5-one, and quinazolinone (for example, succinimide, 3-phenyl-2-pyrazoline-.5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3, 6-dimercapto-1, 4-diphenyl-1H,4H-2,3*a*,5,6*a*-tatraazapentalene). Preferred tone: modifiers include phthalazone or phthalazine.

Supports usable in the thermally developable photosensitive materials include various kinds of polymeric materials, glass, wool fabric, cotton fabric, paper, metal (e.g., aluminum) and those which are convertible to flexible sheets or rolls are preferred in terms of handling as information recording material. Preferred supports usable in thermally developable photosensitive materials are plastic resin films (e.g., cellulose acetate film, polyester film, polyethylene terephthalate film, polyethylene naphthalate film, polyamide film, polyimide film, cellulose triacetate film, polycarbonate film) and biaxially stretched polyethylene terephthalate film is specifically preferred. The thickness of the support is preferably 50 to 300 μm, and more preferably 70 to 180 μm.

In this invention, to improve an electrification property, a conductive compound such as a metal oxide and/or a conducting polymer can be incorporated into a construction layer. These compounds can be incorporated into any layer, preferably into a sublayer, a backing layer and an intermediate layer between a photosensitive layer and a sublayer, etc. In the present invention, the conducting compounds described in U.S. Pat. No. 5,244,773, column 14. through 20, are preferably used.

The coating method of the photosensitive layer, protective layer and backing layer is not specifically limited. Coating can be conducted by any method known in the art, including air knife, dip-coating, bar coating, curtain coating, and hopper coating. Two or more layers can be simultaneously coated. As-a solvent for coating solution are employed organic solvents such as methyl ethyl ketone (also denoted as MEK), ethyl acetate and toluene.

The photothermographic material according to the invention comprises a support having thereon a photosensitive layer, and preferably further on the photosensitive layer having a non-photosensitive layer. For example, it is preferred that a protective layer is provided on the photosensitive layer to protect the photosensitive layer and that a back coating layer is provided on the opposite side of the support to the photosensitive layer to prevent adhesion between photosensitive materials or sticking of the photosensitive material to a roller. Further, there may be provided a filter layer on the same side or opposite side to the photosensitive layer to control the amount or wavelengths of light transmitting the thermally developable photosensitive layer. Alternatively, a dye or pigment may be incorporated into the photosensitive layer. In this case, dyes described in JP-A 8-201959 are preferably used therein. The photosensitive layer may be comprised of plural layers. To adjust contrast, a high-speed layer and low speed layer may be arranged in combination, such as high-speed layer/low-speed layer, or low-speed layer/high-speed layer. Various adjuvants may be incorporated into the photosensitive layer, non-photosensitive layer or other component layer(s). Examples thereof include a surfactant, antioxidant, stabilizer, plasticizer, UV absorbent, and coating aid.

Besides the infrared sensitizing dye relating to this invention, sensitizing dyes exhibiting spectral sensitizing action in the infrared region may be used in combination, including thiacarbocyanines described in JP-B Nos.48-42172, 51-9609, and 55-39818, and JP-A Nos. 62-284343 and 2-105135; tricarbocyanines for infrared semiconductor laser, as described in JP-A Nos. 59-191032 and 60-80841; and dicarbocyanines containing a 4-quinoline nucleus. described in general formulas (IIIa) and (IIIb) of JP-A Nos. 59-192242 and 3-67242.

The photothermographic materials used in this invention are preferably mono-sheet type (i.e., a material provided for image formation being entirely completed as an imaging sheet to be observed). The wavelength of a laser for exposure can be varied depending of a sensitizing dye incorporated to the photothermographic material. In exposure of the photothermographic materials used in this invention, infrared semiconductor lasers (of 780 nm, 820 nm, etc.) are preferably employed. The exposure wavelength of the infrared semiconductor laser is preferably 750 nm or more, and more preferably 800 nm or more.

In the invention, exposure is preferably conducted by laser scanning exposure. It is also preferred to use a laser exposure apparatus, in which scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84, and optimally 70 to 82°. When the photosensitive material is scanned with laser light, the beam spot diameter on the surface of the photosensitive material is preferably not more than 200 μm, and more preferably not more than 100 μm. Thus, the less spot diameter preferably reduces an angle displacing from verticality of the laser incident angle. The lower limit of the beam spot diameter is 10 μm. The thus laser scanning exposure can reduce deterioration in image quality due to reflection light, such as occurrence of interference fringe-like unevenness.

Exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but usually about 60 nm.

Silver images are formed on heating through oxidation-reduction reaction between an organic silver salt (functioning as an oxidant) and a reducing agent. This reaction process proceeds without supplying a processing solution such as water from the outside.

Thus, the photothermographic materials used in this invention are stable at ordinary temperatures, but on heating at a high temperature (e.g., 80 to 200° C.) after exposure, are developed to form silver in exposed areas through oxidation-reduction reaction between an organic silver salt (functioning as an oxidant) and a reducing agent. The heating temperature is preferably 80 to 200° C., and more preferably 100 to 150° C. There cannot be obtained images with sufficiently high densities for a short time at a developing temperature of lower than 80° C. Development at a temperature of higher than 200° C. results in fusion of a binder, leading to its transfer to the roller and disadvantageously affecting not only images themselves but also a transport property or a processor.

EXAMPLES

The present invention will be described based on examples, but embodiments of the invention are not limited to these.

Example 1

Preparation of Support

Both sides of a blue-tinted 175 thick PET film exhibiting a density of 0.160 (measured by densitometer PDA-65, available from Konica Corp.) were subjected to corona discharge at 8 w/m$^2$.

Preparation of Photosensitive Emulsion A

Preparation of Photosensitive Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A.

Em-1

The thus prepared silver halide emulsion A was resolved to a prescribed amount to obtain silver halide grains which were not chemically sensitized.

Em-2

The silver halide emulsion A was resolved to a prescribed amount, heated to 55° C. and $5\times10^{-5}$ mol of Compound A was added thereto. Subsequently, $7\times10^{-5}$ mol of ammonium thiocyanate and $5.3\times10^{-5}$ mol of chloroauric acid were added. Silver iodide fine grains of 0.3 mol% was further added. After ripening for 100 min., the emulsion was cooled to 38° C. to complete chemical sensitization. Chemically sensitized silver halide grains were thus obtained. The addition amount described above was represented by an amount per mol of AgX.

Compound A

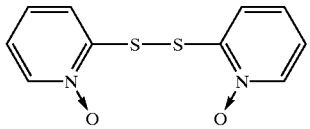

Preparation of Powdery Organic Silver Salt

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion Em-1 or Em-2 (equivalent to 0.038 mol silver) and 450 ml water and stirring further continued for 5 min., while maintained at a temperature of 55° C. Subsequently, 760.6 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 $\mu$S/cm, and after subjecting to centrifugal dehydration, the reaction product was dried with heated air until no reduction in weight was detected to obtain powdery organic silver salts B-1 and B-2.

Preparation of Photosensitive Emulsion-dispersing Solution

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 0.5 min. of a retention time with a mill to obtain photosensitive emulsion dispersing solutions B-1 and B-2.

Preparation of Photosensitive Layer Coating Solution C-1

To 500 g of the photosensitive emulsion dispersing solution B-1, 100 g of methyl ethyl ketone (MEK) was added in a stream of nitrogen with stirring and maintained at 24° C. Antifoggant 1 described below (2.50 ml of 10% methanol solution) was added thereto and stirred for 1 hr., then, calcium bromide (4 ml of 10% methanol solution) was further added and stirred for 15 min. Subsequently, 1.8 ml of a dye-adsorbing aid and potassium acetate (1:5) mixture solution (ethanol solution of 20 wt % dye-adsorbing aid 2) was added and stirred for 15 min. Then, 7 ml of a mixture solution of an infrared sensitizing dye shown in Table 1, 4-chloro-2-benzoylbenzoic acid and supersensitizer, 5-methyl-2-mercaptobenzimidazole (mixing ratio of 1:250:20, methanol solution of 0.1% sensitizing dye) was added and stirred for 1 hr. Thereafter, the temperature was lowered to 13° C. and further stirred for 30 min. Further thereto, 48 g of polyvinyl butyral was added and dissolved, while being maintained at 13° C., and the following additives were added (in which these procedures were carried out in a stream of nitrogen).

| | |
|---|---|
| Phthalazine | 1.5 g |
| Tetrachlorophthalic acid | 0.5 g |
| 4-Methylphthalic acid | 0.5 g |
| Dye of formula (1) shown in Table 1, in an amount giving a density of 0.9 at the absorption maximum | |
| Developing agent 1,1-bis(2-hydroxy-3,5-dimethylphenyl)-2-methylpropane | 15 g |
| Desmodu N3300 (aliphatic isocyanate, available from Movey Corp.) | 1.10 g |
| Antifoggant 2[2-(tribromomethylsulfonyl)quinoline | 1.55 g |

Dye-adsorbing aid

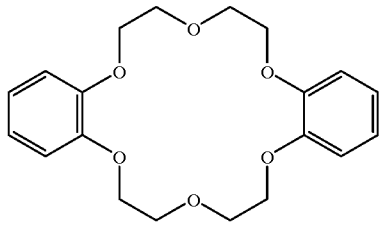

Antifoggant 1

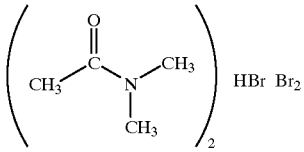

Preparation of Photosensitive Layer Coating Solution C-2

To 500 g of the photosensitive emulsion dispersing solution B-1, 100 g of methyl ethyl ketone (MEK) was added in a stream of nitrogen with stirring and maintained at 21° C. Antifoggant 1 described below (2.50 ml of 10% methanol solution) was added thereto and stirred for 1 hr., then, zinc bromide (4 ml of 10% methanol solution) was further added and stirred for 15 min. Subsequently, 1.8 ml of a dye-adsorbing aid and potassium acetate (1:5) mixture solution (ethanol solution of 20 wt % dye-adsorbing aid 2) was added and stirred for 15 min. Then, 7 ml of a mixture solution of an infrared sensitizing dye shown in Table 1, 4-chloro-2-benzoylbenzoic acid and supersensitizer, 5-methyl-2-mercaptobenzimidazole (mixing ratio of 1:250:20, methanol solution of 0.1% sensitizing dye) was added and stirred for 1 hr. Thereafter, the temperature was lowered to 13° C. and further stirred for 30 min. Further thereto, 48 g of polyvinyl butyral was added and dissolved, while being maintained at 13° C., and the following additives were added (in which these procedures were carried out in a stream of nitrogen).

| | |
|---|---|
| Phthalazine | 1.5 g |
| Tetrachlorophthalic acid | 0.5 g |
| 4-Methylphthalic acid | 0.5 g |
| Dye of formula (1) shown in Table 1, in an amount giving a density of 0.9 at the absorption maximum | |
| Developing agent 1,1-bis(2-hydroxy-3,5-dimethylphenyl)-2-methylpropane | 15 g |
| Desmodu N3300 (aliphatic isocyanate, available from Movey Corp.) | 1.10 g |
| Antifoggant 2[2-(tribromomethylsulfonyl)quinoline | 1.0 g |
| Antifoggant 3 | 0.9 g |

Antifoggant 3

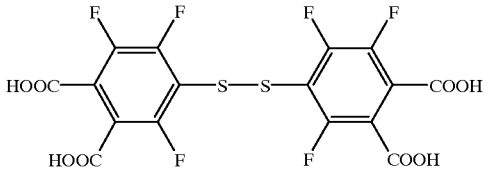

Photosensitive Layer Coating

The coating solution described above was coated on the support so that silver coverage and a coating amount of polyvinyl butyral as a binder were 1.8 g/m$^2$ and 8.5 g/m$^2$, respectively.

Further, the following layers were successively formed to prepare samples Nos. 1 through 18. Drying was conducted at 75° C. for 5 min. in a stream of nitrogen. Back layer coating A solution of the following composition was coated so as to have a wet thickness of 80 $\mu$m.

| | |
|---|---|
| Polyvinyl butyral (10% isopropanol solution) | 150 ml |

Solution of dye shown in Table 1, in an amount giving a density of 0.7 at the absorption maximum Protective Layer Coating A solution of the following composition was coated so as to have a wet thickness of 100 $\mu$m.

| | |
|---|---|
| Acetone | 175 ml |
| 2-propanol | 40 ml |
| Methanol | 15 ml |
| Cellulose acetate | 8 g |
| Phthalazinone (4.5% DMF solution) | 8 ml |
| Phthalazine | 1.5 g |
| 4-Methylphthalic acid | 0.72 g |
| Tetrachlorophthalic acid | 0.22 g |
| Tetrachlorophthalic acid anhydride | 0.5 g |
| Monodisperse silica (av. particle size 4 $\mu$m) | 1 wt%, based on binder |

TABLE 1

| Sample | Photo-sensitive Layer | Dye (Photo-sensitive Layer) | Dye (Back Layer) | Sensi-tizing Dye | Remark |
|---|---|---|---|---|---|
| 1 | C-1 | Comp. A | Comp. A | Comp. | Comp. |
| 2 | C-1 | Comp. B | Comp. B | Comp. | Comp. |
| 3 | C-1 | Comp. C | Comp. C | Comp. | Comp. |
| 4 | C-1 | Comp. D | Comp. D | Comp. | Comp. |
| 5 | C-1 | Comp. E | Comp. E | Comp. | Comp. |
| 6 | C-1 | Comp. F | Comp. F | Comp. | Comp. |
| 7 | C-1 | 1–3 | 1–3 | Comp. | Comp. |
| 8 | C-1 | 1–3 | 1–3 | No. 5 | Inv. |
| 9 | C-1 | 1–1 | 1–1 | No. 41 | Inv. |
| 10 | C-1 | 1–1 | 1–3 | No. 20 | Inv. |
| 11 | C-2 | 1–1 | 1–1 | No. 5 | Inv. |
| 12 | C-2 | 1–1, 1–4 | 1–1 | No. 11 | Inv. |
| 13 | C-2 | 1–1 | 1–3 | No. 20 | Inv. |
| 14 | C-2 | 1–3 | 1–1 | No. 20 | Inv. |
| 15 | C-2 | 1–1 | 1–1, 1–4 | No. 15 | Inv. |
| 16 | C-2 | 1–1, 1–3 | 1–3 | No. 51 | Inv. |
| 17 | C-2 | 1–1 | 1–1, 1–3 | No. 41 | Inv. |
| 18 | C-2 | 1–1, 1–4 | 1–4 | No. 41 | Inv. |

In Sample 12, 16 and 18, dyes were used in a ratio of 1:1 by weight.

Comparative Sensitizing Dye (denoted simply as Comp.)

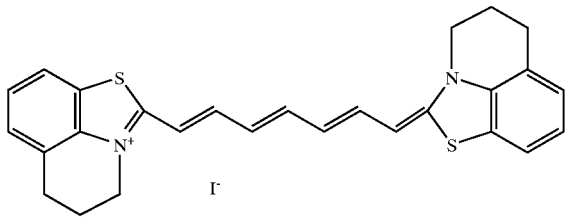

Comparative Dye A (denoted simply as Comp. A)

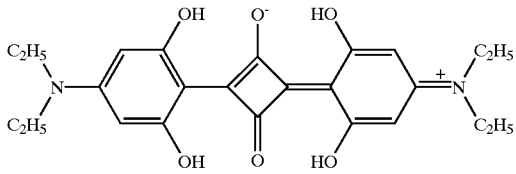

Compound Described in JP-A 10-24654

Comparative Dye B (denoted simply as Comp. B)

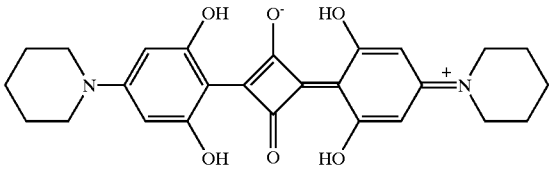

Compound Described in JP-A 10-24654

Comparative Dye C (denoted simply as Comp. C)

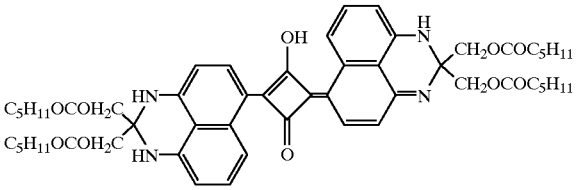

Compound Described in JP-A 2-216140

Comparative Dye D (denoted simply as Comp. D)

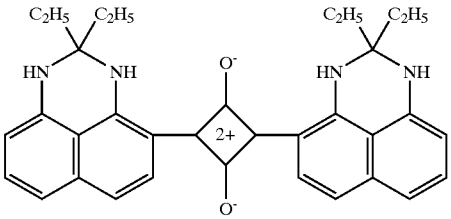

Compound Described in JP-A 10-36695

Comparative Dye E (denoted simply as Comp. E)

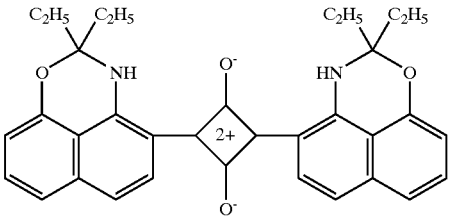

Compound Described in JP-A 10-158253

Comparative Dye F (denoted simply as Comp. F)

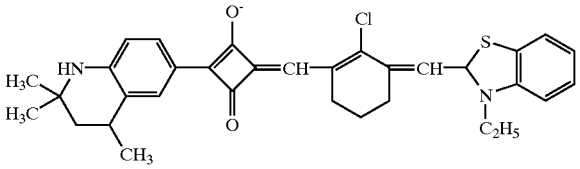

Compound Described in JP-A 10-24654

Sensitometric Evaluation

The thus prepared photothermographic material samples were each cut to a size of 14×17 inches and imagewise exposed to an 810 nm semiconductor laser, in which the angle between the laser beam and the exposed surface of each sample was 80°. The laser output was 75 mW, provided that the laser was subjected to high frequency superposition and outputted in a longitudinal multiple mode, and an exposure time of $1\times10^{-7}$ sec. Thermal processing was carried out by uniformly heating using a heated drum, and development was carried out at 120° C. for 15 sec. The fog density and sensitivity (which was represented by a reciprocal of exposure necessary to give a density of 1.0 plus fog density) were determined, provided that they were shown as a relative value, based on those of Sample No. 1 being 100. Results are shown in Table 1.

Evaluation was also made with respect to sharpness, residual color staining and raw stock stability, according to the following manner.

Evaluation of Sharpness

MTF was measured at 10 lines/mm. The MTF value of each sample was represented by a relative value, based on that of Sample No. 1 being 100.

Evaluation of Residual Color Stain

The visible absorption spectrum of each of processed samples was measured with respect to a fogged portion (i.e., unexposed area). Results were shown by a relative value, based on the optical density at the visible absorption maximum of Sample No. 1 being 100. The lower the value, the better.

Evaluation of Raw Stock Stability

Unexposed photothermographic material samples were initially put into a closed container maintained at 25° C. and 55% RH and allowed to stand at 50° C. for a period of 7 days (i.e., accelerated aging). For comparison, the same photothermographic material samples were put into a light resistant container and allowed to stand at 25° C. and 55% RH for 7 days (i.e., comparative aging). Aged samples were processed in the same manner as in the sensitometric evaluation and the fog density (in unexposed areas) was measured. Raw stock stability was evaluated, based on an increase in fogging, as defined below:

(Increase in fogging)=(Fog density at accelerated aging)−(Fog density at comparative aging)

The increased fogging was regarded as aging fog and represented by a relative value, based on that of Sample No. 1 being 100. Results are shown in Table 2.

TABLE 2

| Sample | Fog | Sensitivity | Sharpness | Visible Absorption | Aging Fog | Remark |
|---|---|---|---|---|---|---|
| 1 | 100 | 100 | 100 | 100 | 100 | Comp. |
| 2 | 106 | 99 | 99 | 114 | 117 | Comp. |
| 3 | 112 | 101 | 98 | 125 | 138 | Comp. |
| 4 | 109 | 98 | 101 | 118 | 125 | Comp. |
| 5 | 110 | 100 | 100 | 120 | 129 | Comp. |
| 6 | 107 | 99 | 100 | 117 | 124 | Comp. |
| 7 | 105 | 100 | 109 | 30 | 113 | Comp. |
| 8 | 75 | 121 | 118 | 29 | 63 | Inv. |
| 9 | 68 | 125 | 120 | 24 | 48 | Inv. |
| 10 | 71 | 123 | 119 | 25 | 52 | Inv. |
| 11 | 69 | 131 | 121 | 25 | 49 | Inv. |
| 12 | 70 | 116 | 120 | 26 | 52 | Inv. |
| 13 | 77 | 126 | 120 | 26 | 65 | Inv. |
| 14 | 72 | 128 | 120 | 25 | 53 | Inv. |
| 15 | 75 | 118 | 119 | 27 | 55 | Inv. |
| 16 | 77 | 117 | 120 | 27 | 57 | Inv. |
| 17 | 68 | 130 | 120 | 24 | 49 | Inv. |
| 18 | 68 | 130 | 120 | 24 | 49 | Inv. |

As can be seen from Table 2, it was shown that inventive samples exhibited lower fog, higher sensitivity, less residual color stain, superior sharpness and improved raw stock stability, as compared to comparative samples.

What is claimed is:

1. A photothermographic material comprising a support and a photosensitive layer containing an organic silver salt, a photosensitive silver halide and a binder, wherein the photosensitive layer or the support contains a dye represented by the following formula (1), and the photosensitive silver halide being spectrally sensitized with at least a sensitizing dye represented by the following formulas (2a) through (2d):

formula (1)

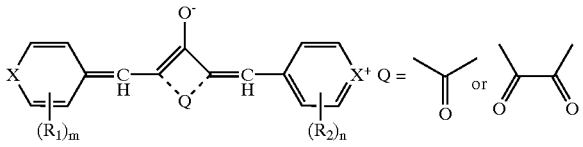

wherein X represents an oxygen or sulfur atom; $R_1$ and $R_2$ each represent a univalent substituent group; m and n are each 0, 1, 2, 3 or 4;

formula (2a)

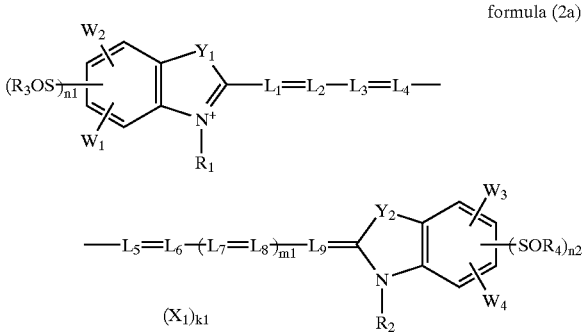

-continued formula (2b)

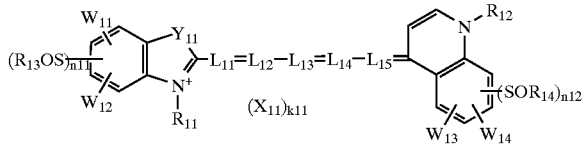

formula (2c)

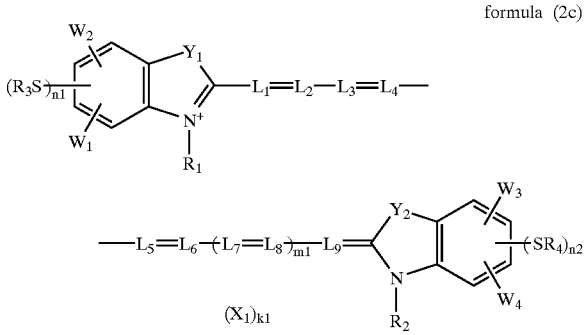

formula (2d)

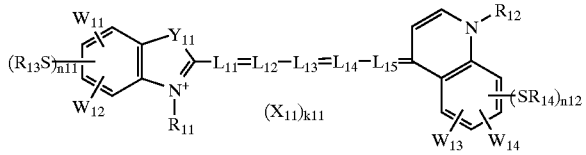

wherein $Y_1$, $Y_2$ and $Y_{11}$ each represent an oxygen atom, sulfur atom, selenium atom or —CH=CH—; $L_1$ through $L_9$ and $L_{11}$ through $L_{15}$ each represent a methine group; $R_1$, $R_2$, $R_{11}$ and $R_{12}$ each represents an aliphatic group; $R_3$, $R_4$, $R_{13}$ and $R_{14}$ each represent an alkyl group, a cycloalkyl group, an alkenyl group, an aralkyl group, an aryl group or a heterocyclic ring group; $W_1$, $W_2$, $W_3$, $W_4$, $W_{11}$, $W_{12}$, $W_{13}$, and $W_{14}$ each represent a hydrogen atom or a substituent group or a non-metallic atom group necessary to form a condensed ring by bonding between $W_1$ and $W_2$, $W_3$ and $W_4$, $W_{11}$ and $W_{12}$, or $W_{13}$ and $W_{14}$, or a non-metallic atom group necessary to form a 5- or 6-membered condensed ring by bonding between $R_3$ and $W_1$, $R_3$ and W2, $R_{13}$ and $W_{11}$, $R_{13}$ and $W_{12}$, $R_4$ and $W_3$, $R_4$ and $W_4$, $R_{14}$ and $W_{13}$, or $R_{14}$ and $W_{14}$; $X_1$ and $X_{11}$ each represent an ion necessary to compensate for an intramolecular charge; k1 and k11 represent the number necessary to compensate for an intramolecular charge; m1 is 0 or 1; n1, n2, n11 and n12 are each 0, 1 or 2, provided that n1 and n2, or n11 and n12 are 0 at the same time.

2. The photothermographic material of claim 1, wherein the photosensitive layer contains the dye of formula (1).

3. The photothermographic material of claim 2, wherein a component layer provided on the opposite side of the support to the photosensitive layer contains the dye of formula (1).

4. The photothermographic material of claim 2, wherein the sensitizing dye is the dye of formula (2a) or (2c).

5. The photothermographic material of claim 1, wherein the dye is contained in the form of a solid particle dispersion.

6. The photothermographic material of claim 1, wherein the photothermographic material further comprises a reducing agent.

7. The photothermographic material of claim 1, wherein $R_1$ or $R_2$ of formula (1) represents an alkyl group ot an aryl group.

8. The photothermographic material of claim 7, wherein the dye of formula (1) is contained in an amount giving 0.3 to 1.5 of absorbance at the wavelength of the absorption maximum of the dye.

9. The photothermographic material of claim 8, wherein the sensitizing dye is the dye of formula (2a) or (2c) and the total amount of said sensitizing dye is $1\times10^{-6}$ to $5\times10^{-3}$ mol per mol of silver halide.

10. The photothermographic material of claim 9, wherein the organic silver salt is a silver salt of a long chain fatty acid, said long chain having 10 to 30 carbon atoms, the amount of the organic silver salt being 0.1 to 3 g/m$^2$, the amount of the silver halide being not more than 50% based on the total amount of the silver halide and organic silver salt, and the amount of the binder in the photosensitive layer being 1.5 to 6 g/m$^2$.

11. The photothermographic material of claim 1, wherein $R_1$ or $R_2$ of formula (1) represents tert-butyl group.

12. The photothermographic material of claim 1, wherein m and n are each 0, 1 or 2.

13. The photothermographic material of claim 1, wherein the dye of formula (1) is contained in an amount giving 0.3 to 1.5 of absorbance at the wavelength of the absorption maximum of the dye.

14. The photothermographic material of claim 1, wherein the total amount of the sensitizing dye of formula (2a) through (2d) is $1\times10^{-6}$ to 5×10–3 mol per mol of silver halide.

15. The photothermographic material of claim 14, wherein the sensitizing dye of formula (2a) or (2c).

16. The photothermographic material of claim 1, wherein the organic silver salt is a silver salt of a long chain fatty acid, said long chain having a 10 to 30 carbon atoms.

17. The photothermographic material of claim 16, wherein the amount of the silver halide is not more than 50% based on the total amount of the silver halide and organic silver salt and the amount of the organic silver salt is 0.1 to 3 g/m$^2$.

18. The photothermographic material of claim 1, wherein the total amount of the silver halide is not more than 50% based on the total amount of the silver halide and organic silver salt.

19. The photothermographic material of claim 1, wherein the amount of the organic silver salt is 0.1 to 3 g.m$^2$.

20. The photothermographic material of claim 1, wherein the sensitizing dye is the dye of formula (2a).

* * * * *